US010329655B2

(12) United States Patent
Martin et al.

(10) Patent No.: US 10,329,655 B2
(45) Date of Patent: Jun. 25, 2019

(54) HEAT TREATMENT OF AN ALLOY BASED ON TITANIUM ALUMINIDE

(71) Applicant: SNECMA, Paris (FR)

(72) Inventors: Guillaume Martin, Moissy-Cramayel (FR); Céline Jeanne Marcillaud, Moissy-Cramayel (FR); Marie Mineur-Panigeon, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 222 days.

(21) Appl. No.: 15/302,418

(22) PCT Filed: Apr. 2, 2015

(86) PCT No.: PCT/FR2015/050871
§ 371 (c)(1),
(2) Date: Oct. 6, 2016

(87) PCT Pub. No.: WO2015/155448
PCT Pub. Date: Oct. 15, 2015

(65) Prior Publication Data

US 2017/0022594 A1 Jan. 26, 2017

(30) Foreign Application Priority Data

Apr. 8, 2014 (FR) ..... 14 53131

(51) Int. Cl.
*C22F 1/18* (2006.01)
*C22C 14/00* (2006.01)
(Continued)

(52) U.S. Cl.
CPC ..... *C22F 1/183* (2013.01); *B21K 3/04* (2013.01); *B22D 7/005* (2013.01); *B22D 13/026* (2013.01);
(Continued)

(58) Field of Classification Search
CPC ..... B21K 3/04; B22D 13/026; B22D 13/04; B22D 13/107; B22D 21/005; B22D 27/15; B22D 7/005; C22C 14/00; C22F 1/183; F01D 5/147; F01D 5/28; F05D 2220/30; F05D 2230/21; F05D 2230/42
See application file for complete search history.

(56) References Cited

U.S. PATENT DOCUMENTS 5,109,603 A * 5/1992 Boulanger ..... H01H 35/26 174/667
5,609,698 A 3/1997 Kelly et al.
(Continued)

FOREIGN PATENT DOCUMENTS

WO WO 2014/057222 A2 4/2014

OTHER PUBLICATIONS

M. Badami et al., "Fatigue Tests of un-HIP'ed γ-TiAl Engine Valves for Motorcycles." International Journal of Fatigue, vol. 28, pp. 722-732, 2006.
(Continued)

*Primary Examiner* — Veronica F Faison
(74) *Attorney, Agent, or Firm* — Blank Rome LLP

(57) ABSTRACT

The invention relates to a method for the treatment of an alloy based on titanium aluminide. The method comprises the following steps, during which no hot isostatic pressing is carried out: obtaining a semi-finished product (7) produced by centrifugal casting, then heat treating the semi-finished product in order to obtain an alloy microstructure comprising gamma grains and/or lamella grains (alpha2/gamma).

16 Claims, 5 Drawing Sheets

Figure 1:
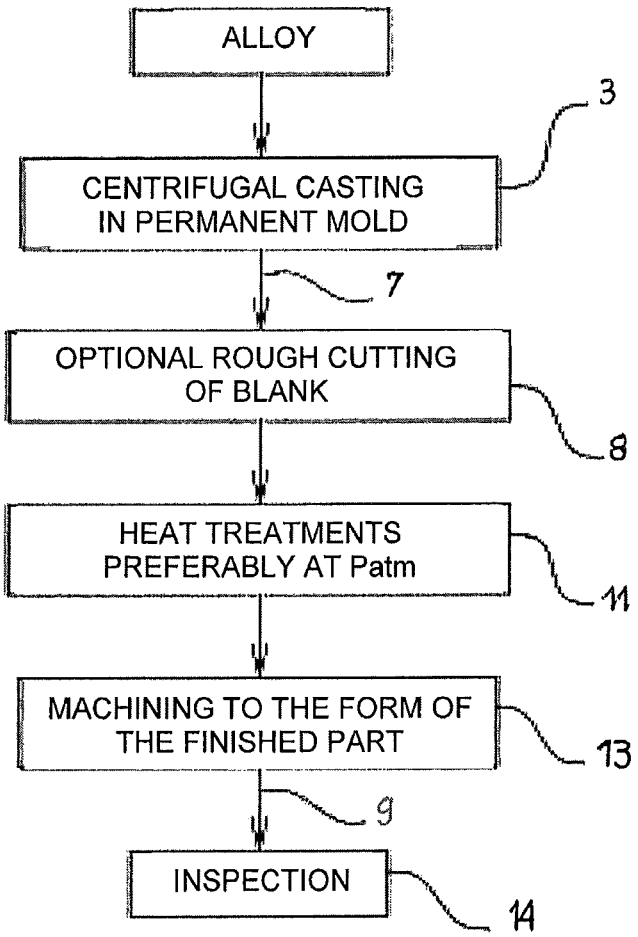

(51) Int. Cl.

| | |
|---|---|
| ***B22D 13/04*** | (2006.01) |
| ***B22D 13/10*** | (2006.01) |
| ***B22D 21/00*** | (2006.01) |
| ***B22D 27/15*** | (2006.01) |
| ***B21K 3/04*** | (2006.01) |
| ***B22D 7/00*** | (2006.01) |
| ***B22D 13/02*** | (2006.01) |
| ***F01D 5/14*** | (2006.01) |
| ***F01D 5/28*** | (2006.01) |

(52) U.S. Cl.

CPC ..... *B22D 13/04* (2013.01); *B22D 13/107* (2013.01); *B22D 21/005* (2013.01); *B22D 27/15* (2013.01); *C22C 14/00* (2013.01); *F01D 5/147* (2013.01); *F01D 5/28* (2013.01); *F05D 2220/30* (2013.01); *F05D 2230/21* (2013.01); *F05D 2230/42* (2013.01)

(56) References Cited

U.S. PATENT DOCUMENTS 6,805,759 B2 * 10/2004 Hoffmann ..... C22C 1/005 148/421
2013/0108459 A1 * 5/2013 Bewlay ..... B22D 21/005 416/241 R
2015/0231746 A1 * 8/2015 Marcillaud ..... B23P 15/02 29/889.7
2015/0352633 A1 * 12/2015 Foltz, IV ..... B22C 9/08 164/286

OTHER PUBLICATIONS

F. Marino et al., "Effects of Low-Cycle Fatigue on Bending Properties and Fracture Toughness of un-HIP'ed Ti-47 A1—2Cr—2Nb—1B Intermetallic." International Journal of Fatigue, vol. 27, pp. 143-153, 2005.

* cited by examiner

HEAT TREATMENT OF AN ALLOY BASED ON TITANIUM ALUMINIDE

The present invention relates to heat treatments of metallurgical alloys and, more particularly, heat treatments of a titanium aluminide alloy.

Titanium aluminides are a class of alloys the compositions of which comprise at least titanium and aluminium, typically a few additional alloy elements.

Titanium aluminides, and in particular those of the gamma type, have the advantage of low density, good resistance to cyclic deformation at low and intermediate temperatures, and good resistance to the environment. They find an application in aircraft engines, as low-pressure turbine blades (for stators or rotors), bearing supports, high-pressure compressor casings, and sealing supports for low-pressure turbines, in particular.

Titanium aluminides, and in particular those of the gamma type, are typically prepared by melting, casting, and then hot isostatic pressing in order to reduce the porosity resulting from the casting, followed by at least one heat treatment in order to obtain a good compromise between the tensile, fatigue and creep mechanical properties.

In order to obtain a microstructure and a degree of porosity ensuring good mechanical properties, it has been proposed in the past to use a combination of a hot isostatic pressing at a temperature of approximately 1200° C., followed by heat treatment at a higher temperature, that is to say approximately 1300° C.

Unfortunately, this required a specialist furnace that was expensive and could not be logistically available in all cases.

In U.S. Pat. No. 5,609,698, it was subsequently proposed, to overcome this problem, to proceed as follows:

- obtaining by casting a gamma titanium-aluminide alloy having approximately 45.0 to approximately 48.5 percent atomic aluminium (in the present application, all the alloy compositions are presented in atoms percent, —at %—, unless indicated to the contrary),
- carrying out a heat treatment (pre-HIP heat treatment) of this alloy at a temperature of between approximately 1035° C. (1900° F.) and approximately 1150° C. (2100° F.) for approximately 5 to 50 hours,
- next effecting a hot isostatic pressing (HIP) of the pretreated alloy, at a temperature of approximately 1175° C. (2150° F.) and at a pressure of approximately 1000 to $1700\times10^5$ Pa, for approximately 3 to 5 hours,
- then carrying out a heat post-treatment of the compressed alloy (post-HIP heat treatment) at a temperature of between approximately 1010° C. (1850° F.) and approximately 1200° C. (2200° F.), for approximately 2 to 20 hours.

The maximum values of these heat treatment temperature ranges are certainly appreciably below the temperature of approximately 1300° C. (2375° F.) used previously.

However, this requirement for strict control of the three parameters, that is to say a high pressure (HIP pressure), a high temperature and a fairly long period, remains very constraining.

However, it appeared against all expectations to the inventors that, in order to facilitate the implementation of heat treatments of a titanium-aluminide alloy, and in particular gamma titanium aluminide, including in the context of the manufacture of a turbine blade from such alloy, that it is not so much (or mainly) the temperature that it is necessary to reduce in relation to a hot isostatic pressing but rather the hot isostatic pressing in itself that it is necessary to reconsider, contrary to what is taught at least by U.S. Pat. No. 5,609,698.

In fact, the quality of the finished products to be obtained (such as turbine-engine turbine blades for aircraft), and the constraints imposed in particular by the previous techniques (costs, equipment, precision), led these inventors to dare to free themselves from the technical prejudices mentioned above.

They were thus able to perceive that it seemed reasonable to be able to dispense with a hot isostatic compacting step, under certain conditions.

They were thus able to define a method for the treatment of a titanium-aluminide alloy, comprising the following steps:

- carrying out casting by centrifugal casting in a permanent mould in order to obtain a semi-finished product,
- then heat treating the semi-finished product,
- this at a pressure below that of a hot isostatic pressing (HIP), preferably substantially equal to atmospheric pressure, until a microstructure of the alloy is obtained comprising gamma grains and/or lamellar grains (alpha2/gamma).

In a comparable fashion, they defined a method for manufacturing a turbine engine part from titanium-aluminide alloy comprising the following steps:

- carrying out casting by centrifugal casting in a permanent mould in order to obtain a semi-finished product with a less complex shape than that of the finished product,
- then heat treating the semi-finished product, without hot isostatic pressing (HIP),
- this at a pressure below that of a hot isostatic pressing, preferably substantially equal to atmospheric pressure, until a microstructure of the alloy is obtained comprising gamma grains and/or lamellar grains (alpha2/gamma).
- then machining the heat-treated semi-finished product into the form of said piece.

On the basis of the information previously supplied, it will have been understood that this "pressure lower than that of a hot isostatic pressing" will therefore necessarily be below $1700\times10^5$ Pa, and preferably below $1000\times10^5$ Pa.

Furthermore, and in fact it was able to be verified:

- that casting by centrifugal casting in a permanent mould makes it possible to appreciably limit the number and size of porosities, so that the criteria applied for example to a turbine blade are complied with in the as-cast state,
- and that the most simple mould shapes are the most effective for reducing the level of porosities.

This has moreover been found by several analyses (observation by optical microscope, dye penetration test, X-radiography) on TiAl 48-2-2 obtained in a cylindrical mould: the few porosities observed did not exceed a few hundreds of micrometers in diameter.

A preferred feature of the invention moreover provides for the step of obtaining the semi-finished product produced by the centrifugal casting to comprise casting in said permanent mould that the alloy will then fill in such a way that the size of the internal pores of this alloy is smaller after casting compared with what it was before.

It will in fact be sought for the simple form of the mould (without undercut) to make it possible for it to be filled quickly by the alloy so as to reduce the size of internal pores compared with what this pore size would be without casting in such a mould.

In a practical fashion, it will be possible favourably to ensure for this purpose:

that the mould can be filled at a rate (speed of flow of the alloy into the mould) that is greater than the rate of core solidification (that is to say in the mould) of the alloy, and/or that the simple form of the mould makes it possible for it to be filled in less than one minute, preferably 30 seconds, and preferably again 20 seconds, by the alloy (such as TiAl 48-2-2 in particular).

It will also be sought, favourably, for it not to generate hot spots (as is known, a hot spot is typically a zone where the temperature of the alloy cast in the mould is higher and/or the flow of this alloy is less favourable, or the diffusion of the heat from the metal to the mould also less favourable, such as at an edge of the mould).

In particular, if the pouring/filling speed of the mould is too slow, there is a risk of impairment of the cast shape.

When the semi-finished product is to be heat treated, after therefore the casting has been carried out on a simple shape still to be machined in order to arrive at the finished part, it is moreover preferred for this to be carried out at a pressure:

lower than that of a hot isostatic pressing, and preferably substantially equal to atmospheric pressure.

As a result then, if it is compared with what was taught in U.S. Pat. No. 5,609,698, where a complex solution involving simultaneous control of a high temperature and high pressure is therefore implemented, the above method will then consist in some way of replacing the step, judged in this prior patent to be essential, of hot isostatic compacting of a product of complex shape (having the shape of the finished part) produced by casting in a temporary mould, with centrifugal casting in a permanent mould, following this casting with a heat treatment without necessarily the high pressure of hot isostatic pressing.

Still in the same approach aimed at the aforementioned effects, it is also advisable for the step of obtaining the semi-finished product produced by casting to comprise:

from the molten alloy casting, the production of a first ingot, in this material, then, after re-melting of this ingot in a cooled metal crucible, pouring it into a centrifuged permanent metal mould in order to obtain a cast ingot, this being followed by removal of the ingot from the mould and if necessary (rough) cutting thereof into a semi-finished product.

Concerning this moulding/cutting aspect, it is moreover advisable for the aforementioned step of obtaining the semi-finished product produced by the casting to comprise said casting in a metal mould, by centrifugal casting of the alloy, alone or followed by (rough) cutting into parts of said moulded alloy, in accordance with a blank of simple shape (corresponding to the simple shape of the permanent mould used):

having at least one symmetry plane, or having externally no more than one deviation by means of which the cross section of the semi-finished blank increases or decreases, with, along said axis:

thickness maxima of the blank situated at ends (in principle opposite ends) thereof, or a thickness maximum of the blank situated at only one end.

Centrifugation in a permanent metal mould will make it possible:

to optimise the filling of the mould, especially if the shape is simple, to minimise the material used; this is because the centre of the mould may not be completely filled, unlike a casting solution with temporary/lost (lost wax) moulds where the pouring feeds are filled with metal, removal from the mould and cutting into a semi-finished product of simple shape that will not require a dimensional check before machining.

A feature of the solution as proposed refers accordingly to heat treating the semi-finished product as cast, and then machining said product directly, without any intermediate dimensional check of a blank.

A simple mould geometry, and therefore a simple geometry for the blank that emerges from its cavity (typically having at least one symmetry plane and/or no more than one deviation) will limit the risks of non-conformity (limitation of the amount of porosities while avoiding creating hot spots). In addition, the fact that the mould is a metal mould will eliminate the risk of obtaining ceramic inclusions produced by the ceramic shell in the case of the lost wax casting method. And a simple geometry of the mould, and therefore of the blank, will allow easy automation of the machining.

The values provided in the present application in relation to the solution proposed should be considered to be accurate to within 20%.

More precisely, it is advisable, in order to heat treat the semi-finished product, for the latter to be raised successively:

to a temperature of between 1045° C. and 1145° C., for 5 to 15 hours, at a pressure lower than that of hot isostatic pressing, preferably substantially equal to atmospheric pressure, to a temperature of between 1135° C. and 1235° C., for 3 to 10 hours, at a pressure lower than that of a hot isostatic pressing, preferably substantially equal to atmospheric pressure, and then to a temperature of between 1155° C. and 1255° C., for 2 to 15 hours, at a pressure lower than that of hot isostatic pressing, preferably substantially equal to atmospheric pressure.

Later in the description, results of tests carried out in this context establish the relevance of such values.

The advantage of the solution presented here will also be noted if the machined part is an aircraft turbine blade, or if the alloy is intended for such a blade, when it is read in WO 2014/057222 on pages 1-2n "that a hot isostatic pressing HIP is [then] necessary in order to close any porosities". The developments presented here make it possible to dispense with a hot isostatic pressing HIP, without the degree of porosity being affected thereby.

Figure 2:
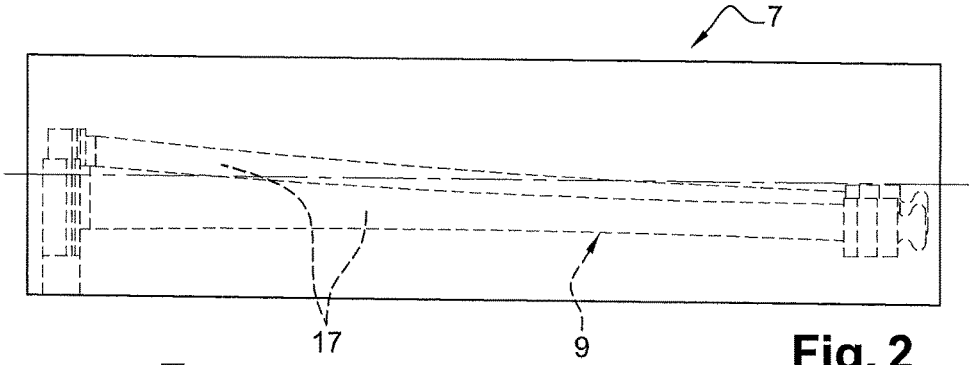
Figure 3:
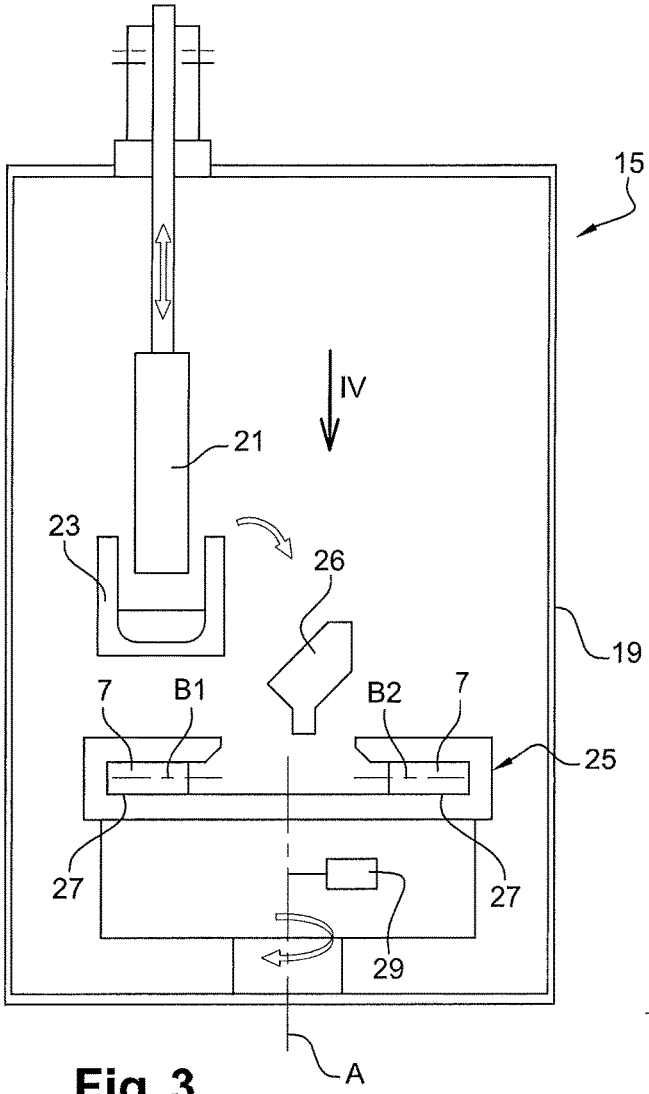
Figure 4:
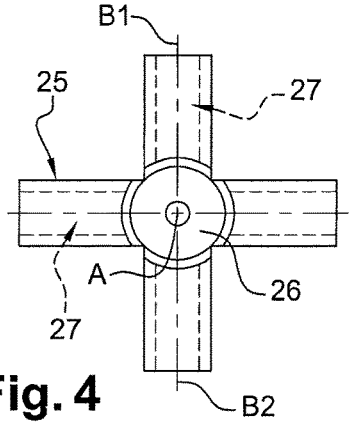
Figure 5:
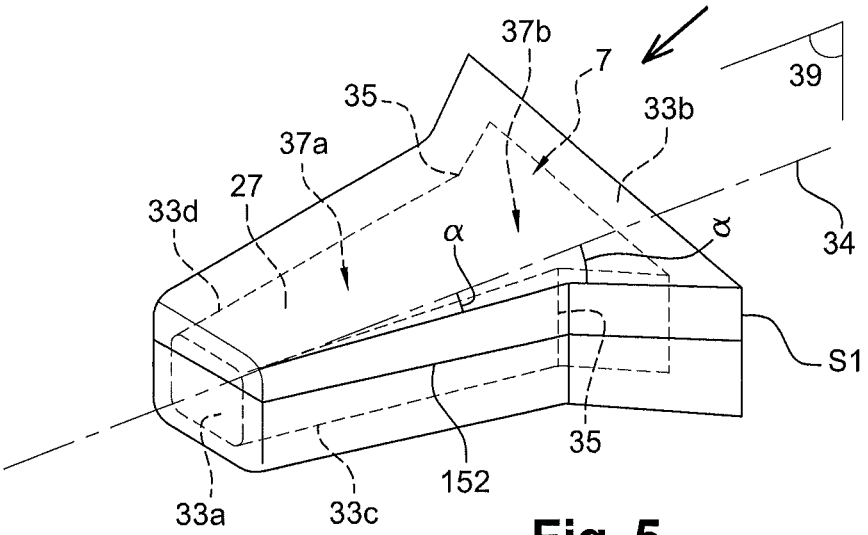
Figure 6:
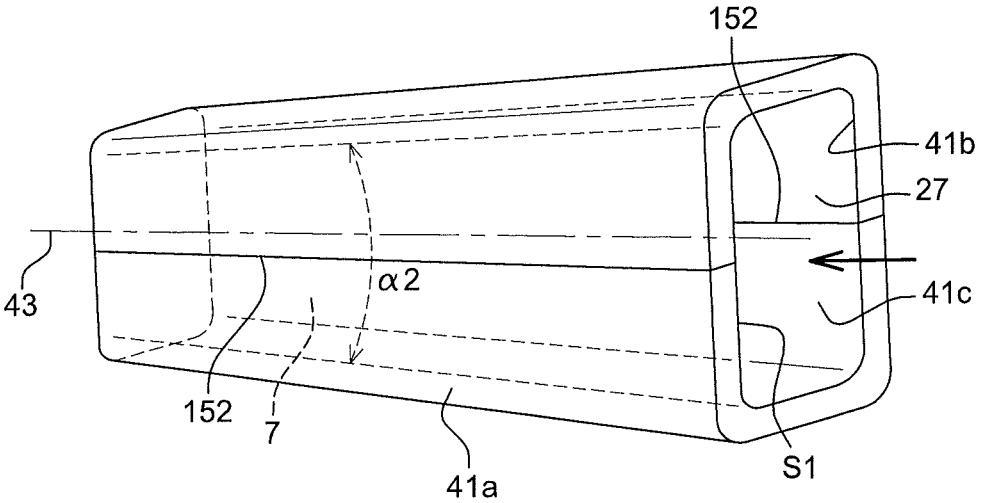
Figure 7:
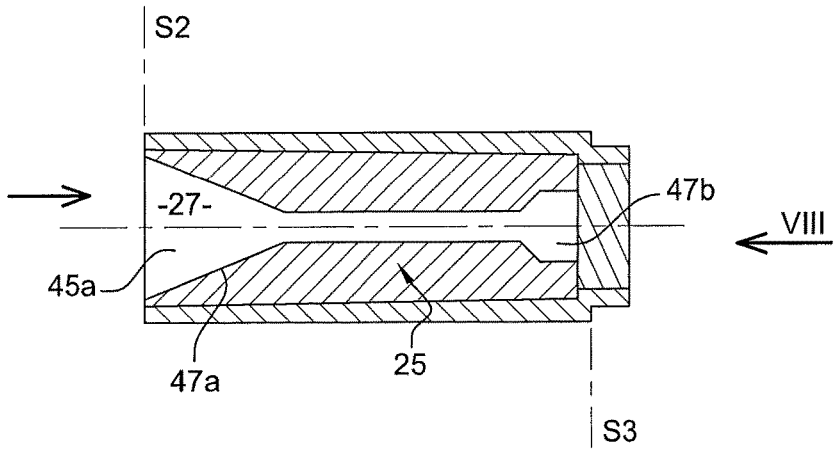
Figure 8:
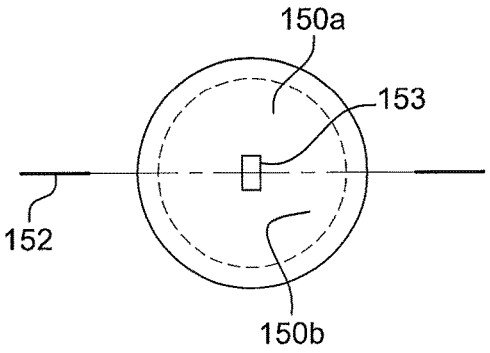
Figure 9:
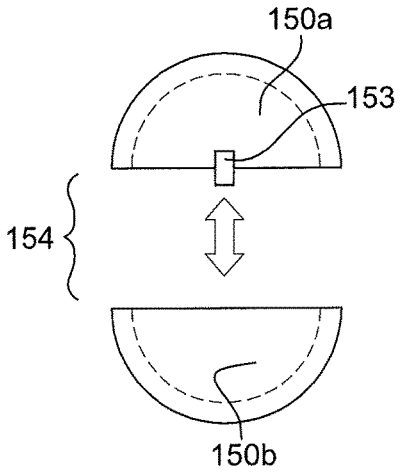
Figure 10:
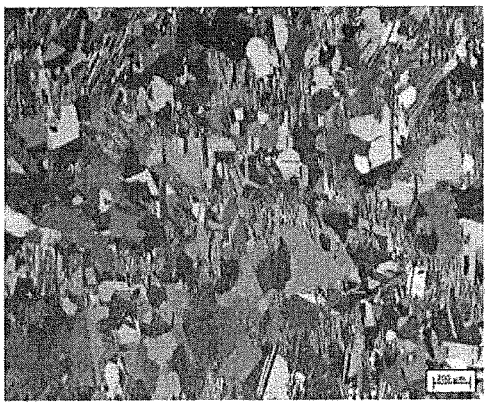
Figure 11:
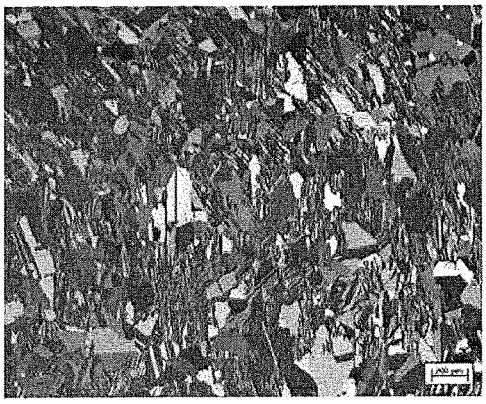
Figure 12:
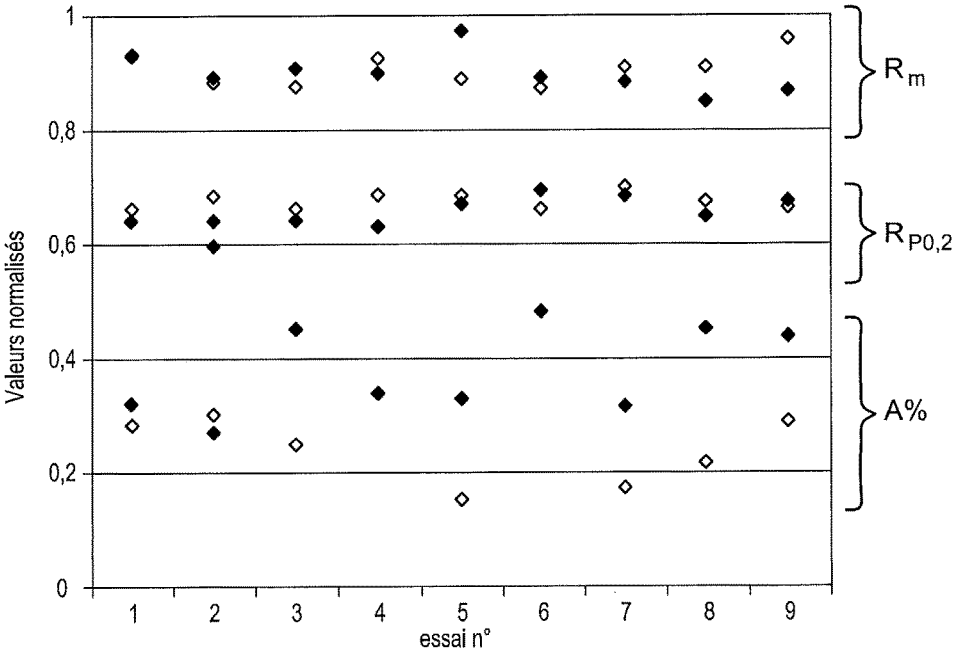

Before this, other features, details and advantages of the invention will emerge from the following relating to example embodiments, the content of which refers to the accompanying drawings, where:

FIG. 1 is a possible functional diagram for the method of the invention;

FIG. 2 is a block produced by casting corresponding to a semi-finished product in which here blades will be able to be machined, FIG. 3 is a schematic view of a device for casting by centrifugal casting in a permanent mould, which can be used here, FIG. 4 is a schematic plan view of the permanent mould of FIG. 3 (arrow IV), FIGS. 5, 6 are two schematic views of permanent moulds, or moulding cavities, with simple shapes that can be used on the aforementioned device illustrated in FIG. 2;

FIGS. 8, 9 show schematically another example of a permanent mould, with a simple shape (cylindrical bar), in a view from the rear (arrow VIII in FIG. 7), respectively closed and open, FIGS. 10, 11 show microstructures obtained respectively with and without hot isostatic compacting, for the same thermal history, and FIG. 12 is a graph obtained from tests (numbered 1 to 9 on the X axis) and illustrates the difference between the relevant result obtained for test pieces (cylinders) heat treated with hot isostatic compacting (solid diamonds) or without hot isostatic compacting (hollow diamonds).

FIG. 1 therefore illustrates the main steps not only of treatment of the alloy concerned, but more generally as a finished product, for example of a turbine blade made from titanium-aluminide alloy.

It can thus be confirmed that no isostatic pressing has been carried out in this case.

Concerning the treatment as such, it therefore consists successively of:

- carrying out, at 3, centrifugal casting, for this purpose pouring the alloy into a permanent mould 5, this making it possible to obtain a semi-finished product 7 with a simple shape, less complex than that of the finished product 9, such as a turbine-engine turbine blade,
- heat treating the semi-finished product, at 11, without necessarily having recourse to hot isostatic pressing.

In this way an alloy microstructure is obtained comprising gamma grains and/or lamellar grains (alpha2/gamma).

Next, for fabricating the finished product 9, the heat-treated semi-finished product will, at step 13, be machined in this form here of one or more turbine blades (see FIG. 2).

For centrifugal casting in a permanent mould, it is possible to use a device 15 as illustrated in FIG. 3, which will make it possible to cast a series of semi-finished blanks 7, each being able to have the form of an as-cast bar where said finished part or parts will then be machined, here two turbine-engine turbine blades 17.

The device 15 comprises a closed sealed enclosure 19 in which a partial vacuum can be applied. An ingot 21, here made from a titanium-aluminide alloy, and more precisely a gamma titanium aluminide, is first of all melted in a crucible 23. When melted, the alloy is next poured into a permanent metal mould 25, via a funnel 26.

The mould 25 makes it possible to cast the alloy by centrifugation, in order to obtain the blanks 7. For this purpose, it is rotated about an axis A. The mould 25 comprises a plurality of cavities 27 that extend radially (axes B1, B2 . . . ; FIGS. 3, 4) about the axis A, preferably by means of a motor 29. These cavities are preferably regularly spaced apart angularly about the axis A, which is here vertical. The centrifugal forces generated by the rotation of the mould force the molten alloy to enter these cavities and to fill them. Thus the alloy to be cast, brought towards the centre of the mould, is distributed radially towards the peripheral cavities.

After cooling, the mould 25 is opened and the cast blanks 7 are extracted. The walls of the mould that surround the cavities 27 connecting the metal withstand the centrifugal forces, typically more than 10 g.

During the rotation about the axis A, the cast alloy will thus be pressed against the walls of these cavities under the action of centrifugal force. To do this, a rotation speed of around 150 to 400 revolutions/minute is recommended.

As is known, through the rotation of the cast liquid metal, the particles are subjected to a centrifugal force, which can be augmented with the angular velocity. This augmentation is distributed over the entire mass of the liquid metal, uniformly over the entire length of each cavity 27.

In FIG. 4, just as in FIGS. 5, 6, 8, apart from the cavities (in one embodiment), the schematic contour of the blank that corresponds to them can be seen in broken lines.

It should also be noted that FIGS. 8, 9 do indeed show schematically a typical feature of a permanent mould, which can be used several times: the mould comprises a plurality of shells, such as 150*a*, 150*b*, which open and close on a surface (here the parting line 152) that is roughly transverse to the axis (A) about which the mould turns.

A separable fixing 153, such as a bolt, is established between the shells in order, once the shells are separated, to be able to take out the cast blank through the opening 154 left free.

In FIGS. 5, 6, the lines 152 also represent a parting line for opening and closing the mould in question.

In FIG. 5, the mould shown has first and second opposite sides 33*a*, 33*b* along the axis 35 and parallel to each other. These two sides are in one case the side where the pouring enters; it is therefore radially internal and the axis is parallel to (or even merged with) one of the axes B, such as B1.

In order to optimise the achieving of a high quality of finished parts and a consumption of material that is as limited as possible, this mould (and therefore the solid blank, the polyhedron obtained) here has, between the aforementioned first and second sides, third and fourth sides (33*c*, 33*d*) that splay in relation to each other from the first side 33*a* towards the second side, at a first angle and then, as from a break in slope (or change in direction) 35, at a second angle greater than the first.

Overall, this mould (its casting cavity) is defined by first and second truncated pyramids 37*a*, 37*b*, the second pyramid being the extension of the first pyramid through the large base of the first pyramid, which is superimposed exactly on the small base of the second.

The mould and its cast blank have a symmetry plane 39 perpendicular to the first and second sides 33*a*, 33*b* and which contains the axis 34.

Provision can also be made, in relation to the angles marked in FIG. 5:

- for the first angle $\alpha$ to be between 0° and 15°;
- for the second angle $\gamma$ to be less than 120°, and preferably less than 90°,
- and for the break in slope 35 to be situated at less than 85%, and preferably less than 75%, of the shortest distance between the first and second sides, starting from the first side 33*a*.

The embodiment of the casting cavity in FIG. 6 illustrates a polyhedral casting cavity having two opposite sides, each with a roughly trapezoidal shape 37*a*, 37*b*.

Like the cavity, the cast blank has here:

- two substantially trapezoidal bases situated facing the two opposite sides with the largest surfaces 41*a*, 41*b*, respectively, along the elongation axis 43, and
- an angular opening ($\alpha$2) of each of these two trapezoidal bases lying between 2° and 10°, and preferably between 3° and 8°, ×N, N being the number of finished products (designed to be) machined fully therein.

Access to the inside of the cavity can be had radially through one of the two lateral sides, here the largest one 41*c*.

Thus, in the above two cases, the blank has externally—on one given side or face—at least one deviation by means of which the cross section of the semi-finished blank increases or decreases, with, along its elongation axis, here 34 or 43, a cross-sectional maximum S1 of the blank situated at only one end, along this axis.

Still in the context of thermal control, preferably in combination with control of forces, FIG. 7 shows another advantageous mould solution where, individually, the open radially internal end 45*a* of the alloy-casting cavity 27 has a shape narrowing in cross section (zone 47*a*) towards the centre of the cavity, along the radial direction B. A truncated cone could be suitable. The shape is here in fact a double funnel (in opposite orientations), with therefore a radially external end part of the cavity, which is shouldered, in order to have a broadened end part 47*b*.

Cross-sectional maxima S2,S3 of mould/cast blank are thus found towards or at the ends, the cross sections S1,S2, S3 each being defined externally, transversely to the elongation axis in question, as illustrated.

Typically, if at least one turbine-engine part is next machined in the blank with a corresponding cast form, the form 47*a* can correspond to the heel region of this blade and the end part 47*b* to the region of the broadened root, or vice versa.

As already indicated, such simple shapes make it possible to assist at least some of the following:

- optimising the filing of the mould,
- facilitating dimensional checks,
- limiting risks of non-conformities (by reducing casting defects),
- easily automating subsequent machinings,
- avoiding creating hotspots and therefore limiting the degree of porosities.

Another effect expected/produced through this centrifugal casting in a permanent mould with a therefore simple shape is the obtaining, at the end of casting, of a blank 7 having, compared with the internal structure of the alloy brought into each cavity 27, an internal (micro) structure the pores of which have a smaller size (volume), or even have disappeared, in order to tend towards a (more) dense material. FIG. 11 shows this result.

In order to favour this by combining the effects of gravity, it is recommended as shown in FIG. 1:

- that, from an initial casting of the alloy (not shown), a first blank corresponding to the ingot 21, which will then be as cast, be produced with this molten alloy,
- then, for this first blank 21 therefore to be remelted in the crucible 23, the remelted alloy being poured into the centrifuged permanent mould 25 in order to obtain a series of cast ingots corresponding to the blanks 7 (which may be referred to as second blanks).

For good technical mastery, the production of the first blank will take place by VAR (vacuum arc remelting) or PAM (plasma arc melting), and then the remelting of this first blank will take place by VAR SM (skull melting—cold fusion crucible).

Next, and preferably, after having removed the blanks 7 from the mould, it will be possible to cut them (roughly) into semi-finished products (step 8, FIG. 1), in accordance with said shape that is "less complex" than that of the finished products that will finally be machined.

In particular, if the shape of the blank removed from the mould or that of the finished product so requires, for example in order to obtain a favourable symmetry plane, the blank removed from the mould can thus be cut into a shape not requiring a dimensional check before it is machined in accordance with the expected finished product; see the final dimensional-check step 14 after machining, FIG. 1.

In the meantime, each semi-finished product 7 will have been heat treated, without hot isostatic pressing, in order to obtain an alloy microstructure comprising gamma grains and/or lamellar grains (alpha2/gamma).

FIGS. 10, 11 show microstructures of TiAl 48-2-2: 48% Al, 2% Cr, 2% Nb (at %) obtained respectively with and without hot isostatic compacting, for the same thermal history.

In FIG. 12, it is, for each test (numbered 1 to 9 on the X axis), the difference between the result concerned obtained for a test piece (a cylinder) heat treated with hot isostatic compacting (solid diamonds) and then another identical one treated without hot isostatic compacting (hollow diamonds) that is to be considered on each occasion.

There is thus found, from top to bottom on the graph:

- (on the Y axis) between 0.8 and 1, the tensile test results (maximum force Rm),
- between 0.58 and 0.8, the elastic limit test results at 0.2% plasticity (Rp 0.2),
- between 0.158 and 0.55, the results of breaking elongation tests (A %).

It will have been noted that tests 1, in Rm, and 4, in A %, show almost exact agreement (superimposition) of the results with hot isostatic compacting (solid diamonds) and without (hollow diamonds). The other results are close, in pairs. And, when they exist, dispersions are small.

All these tests were conducted at ambient temperature, after heat treatments, once again with a test piece (a cylinder) made from TiAl 48-2-2.

In order to achieve the results in FIGS. 11, 12 without hot isostatic compacting, the tests showed that, when the semi-finished product was heat treated, this should favourably be done for 10 to 40 hours, at a pressure substantially equal to atmospheric pressure or, at least, appreciably lower than the hot isostatic compacting pressure ($800–1800\times10^5$ Pa).

An intermediate pressure between atmospheric pressure and this range of hot isostatic compacting pressures applied to the alloy would not be detrimental. It simply does not appear essential. The test results provided are the consequence of the application of atmospheric pressure.

In terms of durations and temperatures, the results in FIGS. 11, 12 are the illustrations of what was obtained indifferently by testing the limit values mentioned below.

The comparative case in FIG. 10 was obtained under the following conditions (see U.S. Pat. No. 5,609,698): first treatment, referred to as PLL treatment, comprising a pre-HIP treatment of 1145° C. for 5 hours, HIP at 1255° C., and heat treatment at 1200° C. for 2 hours.

In fact, FIGS. 11, 12 show the efficacy of the solution proposed here of treating the semi-finished product still to be machined, raised successively:

- to a temperature of between 1045° C. and 1145° C., for 5 to 15 hours, at a pressure substantially equal to atmospheric pressure,
- to a temperature of between 1135° C. and 1235° C., for 3 to 10 hours, at a pressure substantially equal to atmospheric pressure, then
- to a temperature of between 1155° C. and 1255° C., for 2 to 15 hours, at a pressure substantially equal to atmospheric pressure.

The alloy used may in particular be TiAl 48-2-2: 48% Al, 2% Cr; 2% Nb (at %), especially as this intermetallic material proves useful for producing at least partly certain stages of an aircraft turbine-engine turbine, the invention is more generally applicable in particular to titanium-aluminide alloys cited below having a composition capable of forming alpha2 and gamma phases, when the alloy is cooled from a molten mass. It should be noted that these alloys are here, as generally in the prior art, referred to as "gamma"

even if they are not entirely within the gamma phase field, gamma titanium aluminides typically being titanium alloys, with approximately 40 to 50 atomic (at %) aluminium, with optionally small quantities of other alloy elements such as chromium, niobium, vanadium, tantalum, magnesium and/or boron.

The preferred compositions are approximately 45.0 to approximately 48.5 percent atomic aluminium, and are therefore at the upper end of the operating range.

Among the preferred gamma titanium aluminides that can be used, are: Ti-48Al-2Cr-2Nb, Ti-48Al-2Mn-2Nb, Ti-49Al-1V, Ti-47Al-1Mn-2Nb-0.5W-0.5Mo-0.2Si, and Ti-47Al-5Nb-1W. If the manufacturing conditions (in particular the heat treatment) applied to these specific alloys correspond to the aforementioned case of TiAl 48-2-2, in relation to FIGS. 11-12, the results supplied in FIG. 12 will be applicable to them. The importance of such heat treatment without hot isostatic pressing will therefore be understood, at a pressure below that of a hot isostatic pressing, preferably substantially equal to atmospheric pressure, and this for 10 to 40 hours and between 1045° C. and 1255° C. The flow-rate conditions of the alloy in the mould and of the simple shape of this mould also have their importance and are those that were used for tests the results of which are comparable to those of FIGS. 11-12.

The invention claimed is:

1. A method for treating a titanium-aluminide alloy including 40 to 50 percent atomic (at %) aluminium, the method comprising the following steps:

carrying out a centrifugal casting in a permanent mould in order to obtain a semi-finished product, and then heat treating the semi-finished product at a pressure below $1700\times10^5$ pascals (Pa) until a microstructure of the alloy comprising gamma grains and/or lamellar grains (alpha2/gamma) is obtained, wherein the heat treating is made between 1045° C. and 1255° C. during 10 to 40 hours.

2. A method for fabricating, without a hot isostatic pressing, a turbine-engine part made from titanium-aluminide alloy including 40 to 50 percent atomic (at %) aluminium, comprising the following steps:

carrying out centrifugal casting in a permanent mould in order to obtain a semi-finished product with a form less complex than that of the finished product, heat treating the semi-finished product without hot isostatic pressing, at a pressure lower than $1700\times10^5$ pascals (Pa) until an alloy microstructure comprising gamma grains and/or lamellar grains (alpha2/gamma) is obtained, wherein the heat treating is made between 1045° C. and 1255° C. during 10 to 40 hours, and then machining the heat-treated semi-finished product to the form of said part.

3. The method according to claim 1, wherein the step of obtaining the semi-finished product produced by the centrifugal casting comprises casting in said permanent mould filled by the alloy, so that the size of the internal pores of this alloy is reduced after casting compared with what is was before, the mould being filled by the alloy:

with a speed of flow of the alloy in the mould greater than the rate of solidification of the alloy in the mould, and/or in less than one minute.

4. The method according to claim 1, wherein said alloy is one of the following alloys: Ti-48AL-2Cr-2Nb, Ti-48AL-2Mn-2Nb, Ti-49Al-1V, Ti-47Al-1mn-2Nb-0.5W-0.5Mo-0.2Si, and Ti-47Al-5nb-1W.

5. The method according to claim 1, wherein said alloy is TiAl 48-2-2: 48% Al 2% Cr 2% Nb (at %).

6. The method according to claim 1, wherein the step of obtaining a semi-finished product produced by casting comprises said centrifugal casting in a metal mould, following by cutting of said cast alloy into parts in accordance with a blank having at least one symmetry plane.

7. The method according to claim 1, wherein said step of obtaining a semi-finished product produced by casting, which has an axis and, along this axis, a variable external cross section, comprises:

said centrifugal casting in a metal mould, following by cutting of said cast alloy into parts in accordance with a blank having externally no more than one deflection by means of which the cross section of the semi-finished blank increases or decreases, with, along said axis:

cross-sectional maxima of the blank situated at ends thereof, or a cross-sectional maximum of the blank situated at only one end.

8. The method according to claim 2, wherein the semi-finished product as cast is heat treated and is then machined directly, without any intermediate dimensional check.

9. The method according to claim 2, wherein the step of obtaining the semi-finished product produced by casting comprises:

from a casting of said molten alloy, producing a first ingot in this material, remelting the first ingot in a cooled metal crucible and pouring the first remelted ingot into a centrifuged permanent metal mould in order to obtain a cast remelted ingot, and removing the cast remelted ingot from the mould and cutting it into semi-finished product, in accordance with said less complex form.

10. The method according to claim 9, wherein:

producing the first ingot is done by VAR (vacuum arc remelting) or by PAM (plasma arc melting), and remelting the first ingot is done by VAR SM (skull melting-cold fusion crucible).

11. The method according to claim 1, wherein the semi-finished product is heat treated by raising it successively:

to a temperature of between 1045° C. and 1145° C., for 5 to 15 hours, to a temperature of between 1135° C. and 1235° C., for 3 to 10 hours, at a pressure less than that of hot isostatic pressing, and then to a temperature of between 1155° C. and 1255° C., for 2 to 15 hours, at a pressure less than that of hot isostatic pressing.

12. The method according to claim 1, wherein the treatment of the alloy is done without hot isostatic pressing.

13. The method according to claim 2, wherein the machined part is a turbine blade for an aircraft.

14. The method according to claim 1, wherein the alloy is intended for a turbine blade for an aircraft.

15. The method of claim 3, wherein the mould is filled with the alloy in 30 seconds.

16. The method of claim 3, wherein the mould is filled with the alloy in 20 seconds.

* * * * *